United States Patent [19]

Murata et al.

[11] 4,307,566

[45] Dec. 29, 1981

[54] BULKY SPUN YARN AND A METHOD FOR MANUFACTURING THE SAME FROM A COMBINATION OF THERMALLY EXTENSIBLE AND THERMALLY SHRINKABLE FIBERS

[75] Inventors: Goro Murata; Osamu Wada, both of Takatsuki; Shunichi Takeda, Kyoto, all of Japan

[73] Assignee: Teijin Limited, Osaka, Japan

[21] Appl. No.: 114,593

[22] Filed: Jan. 23, 1980

[30] Foreign Application Priority Data

Feb. 5, 1979 [JP] Japan ..... 54/11375

[51] Int. Cl.[3] ..... D02G 3/24; D02G 3/36

[52] U.S. Cl. ..... 57/228; 28/281; 57/3; 57/6; 57/12; 57/253; 57/254; 57/255; 428/369; 428/370; 428/394; 428/395; 428/399

[58] Field of Search ..... 428/370, 369, 399, 394, 428/395; 28/281; 57/3, 6, 12, 253, 254, 255, 228

[56] References Cited

U.S. PATENT DOCUMENTS

| | | | |
|---|---|---|---|
| 3,111,805 | 11/1963 | Boyer | 428/370 |
| 3,325,876 | 6/1967 | Ibrahim | 57/255 |
| 3,439,490 | 4/1969 | Tarkington | 57/254 |
| 3,568,428 | 3/1971 | Stemford et al. | 57/254 |
| 3,596,459 | 8/1971 | Wada et al. | 57/6 |
| 3,852,948 | 12/1974 | Ruddell | 57/255 |
| 3,998,042 | 12/1976 | Reese | 428/369 |

FOREIGN PATENT DOCUMENTS

| | | | |
|---|---|---|---|
| 2039560 | 8/1980 | United Kingdom | 57/253 |

*Primary Examiner*—James C. Cannon

*Attorney, Agent, or Firm*—Burgess, Ryan and Wayne

[57] ABSTRACT

A double layered yarn having a sheath and core structure is prepared through a roving process, drawing process or fine spinning process. The sheath portion of the yarn is composed of staple fibers which have a high thermal shrinkage in boiling water of at least 5%, and the blended fiber ratio of which is between 50% and 25%. The core portion of the yarn is composed of staple fibers which have a property being spontaneously extensible, and the blended fiber ratio of which is between 25% and 75%. The double layered yarn is subjected to a heat treatment in hot water, and a bulky spun yarn which comprises staple fibers A and B is obtained. The staple fibers A are concentrated toward the inside of the bulky spun yarn after they are shrunk. The ends of staple fibers B are held within the inside of the bulky spun yarn, and the intermediate portions of fibers B are bulged as a loop from the body portion of the bulky spun yarn, after the fibers B are spontaneously extended.

10 Claims, 12 Drawing Figures

BULKY SPUN YARN AND A METHOD FOR MANUFACTURING THE SAME FROM A COMBINATION OF THERMALLY EXTENSIBLE AND THERMALLY SHRINKABLE FIBERS

The present invention relates to a bulky spun yarn, which has a specially designed structure and an excellent feel created thereby, and a method for manufacturing the same.

The term "a fiber having a thermal shrinkage" used herein means that the fiber has a property that causes the fiber to shrink to a length $L_1$ from an original length $L_0$ when the fiber is subjected to a heat treatment. In this case, the change per unit length which is defined as $110\times(L_0-L_1)/L_0$ is called thermal shrinkage.

The term "a fiber having a property being spontaneously extensible" used herein means that the fiber has property that causes the fiber to spontaneously extend to a length $L_2$ from an original length $L_0$ when the fiber, whose ends are a free condition, is subjected to a heat treatment. In this case, the elongation, which is defined as $100\times(L_2-L_0)/L_0$, is called "spontaneous extension".

The term "blended fiber ratio" means the percentage of the weight of the fibers to that of the entire yarn, i.e., a double layered yarn which has not been subjected to a heat treatment or a bulky spun yarn which has been subjected to a heat treatment.

PRIOR ART OF THE INVENTION

Conventionally, various types of bulky spun yarns have been developed, and several methods for manufacturing the same have been proposed. In a typical one of these methods for manufacturing a bulky spun yarn, fibers having a high thermal shrinkage and fibers having a low thermal shrinkage are randomly mixed in a known mixed spinning manner, so that a spun yarn is obtained, and; then, the spun yarn thus obtained is subjected to a heat treatment, so that the fibers having a high thermal shrinkage are highly shrunk, and as a result, a bulky spun yarn is obtained. However, in such a bulky spun yarn, the fibers having a high thermal shrinkage concentrate toward the inside of the yarn together with a large number of the fibers having low thermal shrinkage, and accordingly, the fiber density around the center of the yarn is increased and the fiber density at the periphery of the yarn is decreased. In this connection, because the fiber density around the center of the yarn is excessively increased, the binding force between the fibers is proportionally increased, and accordingly, there is a disadvantage in that the obtained yarn lacks a bulky hand and does not have a rich and well formed feeling. In addition, there is another disadvantage in that the alignment of the fibers having a low thermal shrinkage and located at the periphery of the yarn is disturbed by the fibers having a high thermal shrinkage and located at the outermost periphery of the yarn when the yarn is subjected to a heat treatment, and accordingly, the feel of the obtained bulky spun yarn becomes hard and rough. Furthermore, as mentioned above, since the fibers having a low thermal shrinkage occupy almost the entire periphery of the above-mentioned spun yarn, and since the alignment of the fibers is disturbed, the free ends of fibers having a low thermal shrinkage protrude from the body portion of the yarn as fuzz. As a result, there is still another disadvantage in that the appearance of the bulky spun yarn and the appearance of the textile wherein the bulky spun yarn is utilized are poor, and the fuzz creates pilling.

SUMMARY OF THE INVENTION

An object of the present invention is to provide a bulky spun yarn by which the above-mentioned disadvantages can be eliminated, which has only a small amount of fuzz, is not hard or rough and has a soft feel.

According to the present invention, the above-mentioned object is accomplished by a bulky spun yarn comprising at least two kinds of staple fibers. The bulky spun yarn is characterized in that it is composed of:

a first kind of staple fibers A which are concentrated toward the inside of the bulky spun yarn when the fibers A are shrunk, and;

a second kind of staple fibers B, the ends of which are held within the inside of the bulky spun yarn and the intermediate portions of which bulge from the body portion of the bulky spun yarn when the fibers B are spontaneously extended. The bulky spun yarn is also characterized in that, when the bulky spun yarn is cross sectioned perpendicular to the yarn axis, the central portion of the bulky spun yarn includes both first and second kinds of staple fibers A and B, and the peripheral portion of the bulky spun yarn mainly includes the second kind of staple fibers B.

Another aspect of the present invention pertains to a method for manufacturing the above mentioned improved bulky spun yarn. According to this aspect of the present invention, a method for manufacturing a bulky spun yarn is provided which is characterized by: preparing a double layered yarn having a sheath and core structure, and; heat treating the prepared double layered yarn. The sheath portion of the double layered yarn is composed of staple fibers which include fibers having a high thermal shrinkage in boiling water of at least 5% and the blended fiber ratio of which is between 50% and 25%. The core portion of the prepared double layered yarn is composed of staple fibers which include other fibers having a property of being spontaneously extensible and the blended fiber ratio of which is between 25% and 75%. Due to the heat treatment, the intermediate fibers having a property of being spontaneously extensible and bulged from the body portion of the yarn, and the fibers having a high thermal shrinkage are concentrated toward the inside of the bulky spun yarn.

The construction of the bulky spun yarn of the present invention will now be explained in detail. A bulky spun yarn of the present invention comprises at least two kinds of staple fibers, which are: a first kind of staple fibers A which are concentrated toward the inside of the bulky spun yarn when the fibers A are shrunk, and; a second kind of staple fibers B, the ends of which are held within the inside of the bulky spun yarn and the intermediate portions of which are bulged from the body portion of the bulky spun yarn when the fibers B are spontaneously extended. The number of kinds of fibers composing the fibers A is not limited and the fibers A may be composed of two or more kinds of fibers, if the fibers have a tendency to concentrate toward the inside of the yarn when they are subjected to a heat treatment. The material of the fibers A is also not limited, however, it is preferable that the fibers A be made of one or more thermoplastic polymer, such as polyester (polyethylene terephthalate or polybuthylene terephthalate) or polyamide (nylon 6 or nylon 66), and it is more preferable that the fibers A be made of a polyester polymer, so as to enhance the feel of the obtained bulky spun yarn. Similarly, the number of kinds of fibers composing the fibers B is not limited and the fibers B may be composed of two or more kinds of fibers, if the fibers have such a tendency that their intermediate portions bulge from the body portion of the yarn when they are subjected to a heat treatment and extend spontaneously. The material of the fibers B is not limited, however, it is preferable that the fibers B also be made of one or more thermoplastic polymer, such as polyester or polyamide.

It is preferable that the spun yarn obtained as mentioned above include the fibers A, which have been thermally shrunk and the blended fiber ratio of which is between 50% and 25% and the fibers B which have been spontaneously extended and the blended fiber ratio of which is between 25% and 75%. The bulky spun yarn of the present invention is preferably utilized in milled-like woven fabrics and raised fabrics, such as flano or saxony. In the latter case, the loops of the yarn are subjected to a raising operation, and the thus obtained fabrics have a very small uneven raising.

BRIEF DESCRIPTION OF THE DRAWINGS

The present invention will now be explained in detail with reference to the accompanying drawing, wherein.

DETAILED DESCRIPTION OF THE INVENTION

Figure 1:
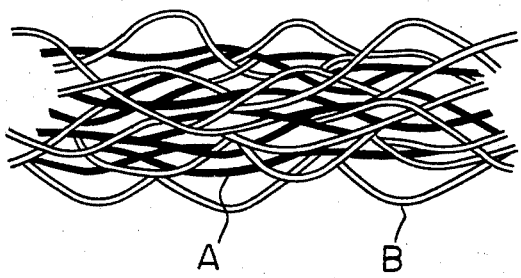
FIG. 1 is an enlarged diagrammatical side view of a bulky spun yarn according to the present invention.
Figure 2:
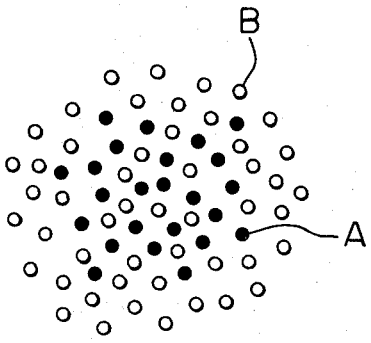
FIG. 2 is an enlarged cross sectional view of the bulky spun yarn.

Referring to FIGS. 1 and 2 which are a diagrammatical side view and a diagrammatical cross sectional view of a bulky spun yarn of the present invention, respectively. As illustrated in FIG. 1, staple fibers A, which are colored black in FIGS. 1 and 2, concentrate toward the inside of the yarn so as to gather both the staple fibers A and ends of staple fibers B, which are colored white in FIGS. 1 and 2. The gathering effect is partly achieved by twists imparted to the spun yarn, and furthermore, the gathering effect in the present bulky spun yarn is maily achieved by the combination of the staple fibers A having been thermally shrunk and the staple fibers B having been spontaneously extended. Accordingly, the spun yarn according to the present invention easily obtains bulkiness. Referring to FIG. 1, ends of the staple fibers B are held within the inside of the yarn, and intermediate portions of the staple fibers B are bulged from the body portion of the yarn like loops. To establish such a construction, it is preferable that staple fibers which have a property being spontaneously extensible be utilized for the staple fibers B. Since the staple fibers A and B are mixed together at the central portion of the spun yarn, as illustrated in FIG. 2, and at the periphery of the spun yarn the staple fibers B mainly exist, and in addition, the intermediate portions of the staple fibers B are bulged from the body portion of the spun yarn, the entire spun yarn has an excellent bulkiness while the fibers B do not excessively gather at the central portion of the spun yarn.

The above-mentioned bulky spun yarn is manufactured, for example, in accordance with the following method. First a double layered yarn having a sheath and core structure is prepared, and then, the prepared double layered yarn is subjected to a heat treatment. In this case, staple fibers constituting the core portion of the double layered yarn include staple fibers having a property being spontaneously extensible, the blended fiber ratio of which is between 25% and 75%, and staple fibers constituting the sheath portion of the double layered yarn include staple fibers having a thermal shrinkage in the boiling water of at least 5%, the blended fiber ratio of which is between 50% and 25%. In this case, it is possible that the core portion may include other staple fibers which are mixed with the above-mentioned fibers having a property being spontaneously extensible and which are different therefrom, and that, similarly, the sheath portion may include other staple fibers which are mixed with the staple fibers having a thermal shrinkage and which are different therefrom.

On one hand, if the blended fiber ratio of the fibers having a property being spontaneously extensible is less than 25%, when the double layered yarn is subsequently subjected to a heat treatment, the amount of the fibers which bulge from the body portion of the spun yarn is insufficient to create a high bulkiness as a spun yarn. On the other hand, if the blended fiber ratio exceeds 75%, the blended ratio of the yarn having a high thermal shrinkage becomes less than 25%, and then, the bulky spun yarn of the present invention cannot be obtained for the reason which will be explained hereinbelow.

If the blended fiber ratio of the fibers having a high thermal shrinkage is less than 25%, which means the excessive decrease of the blended fiber ratio of the staple fibers A constituting the bulky spun yarn, the ability of the fibers to hold the ends of the staple fibers B becomes poor and the fiber characteristics, such as extension recoverability, of the obtained spun yarn are degraded. Contrary to this, if the blended ratio of the fibers having a high thermal shrinkage exceeds 50%, the bulge of the fibers having a property being spontaneously extensible, which have been located at the inside the double layered yarn, through the clearances formed between the fibers having a high termal shrinkage to the periphery of the spun yarn is prevented.

Naturally the deniers of the staple fibers constituting the core and sheath portions may be selected in accordance with the use of the textile, i.e., a woven or knitted fabric, wherein the bulky spun yarn of the present invention is utilized. It is, however, preferable that the denier of each fiber having a high thermal shrinkage and located at the sheath portion in the double layered yarn be between 1.0 de and 15 de and the fiber length of the fiber be between 24 mm and 250 mm. Similary, it is preferable that the denier and fiber length of each fiber having a property being spontaneously extensible and located at the core portion in the double layered yarn be between 0.5 de and 10 de, and between 24 mm and 180 mm, respectively. In general, it is preferable that the core portion in the double layered yarn be composed of fibers which have a relatively small denier, and that the sheath portion in the double layered yarn be composed of fibers, which have a relatively large denier. This is because the spun yarn resulting from such a double layered yarn has an excellent feel created by the fine fibers B and a springiness created by the thick fibers A.

The fibers having a high thermal shrinkage and constituting the sheath portion of said double layered yarn must have a thermal shrinkage in boiling water of equal to or more than 5%, so that the entire spun yarn is shrunk and so that a bulky spun yarn which has appropriate characteristics can be obtained.

The spontaneous extension of the fibers having a property being spontaneously extensible and constituting the core portion of the double layered yarn should be selected in conjunction with the thermal shrinkage of the fibers having high thermal shrinkage and constituting the sheath portion of the double layered yarn. It is preferable the difference in elongations of the fibers having a thermal shrinkage and the fibers having a property being spontaneously extensible, i.e., the sum of the thermal shrinkage and the spontaneous extension, be equal to or more than 8%. Accordingly, since the minimum thermal shrinkage is 5% as mentioned above, it is preferable that the spontaneous elongation at a temperature of 100° C. be equal to or more than 3%.

If a yarn includes fibers having a property being spontaneously extensible at its core portion but does not include any fibers having a high thermal shrinkage, a spun yarn which is similar to the spun yarn of the present invention can be obtained. This is because the fibers having a property being spontaneously extensible bulge toward the periphery of the spun yarn when they are subject to heat treatment. However, since fibers which have been located at the sheath portion have been shrunk only an amount less than 5%, the spun yarn thus obtained lacks springiness and liveliness, and the fibers which have spontaneously extended may fall out when they receive only a slight external force. The preferable ranges of the thermal shrinkage of fibers constituting sheath portion and the spontaneous extension of fibers constituting core portion will be explained later in conjunction with Example 1.

Methods for preparing the above-mentioned double layered yarn having a sheath and core structure by utilizing the above-mentioned fibers having a high thermal shrinkage and a property being spontaneously extensible will now be explained.

Figure 3:
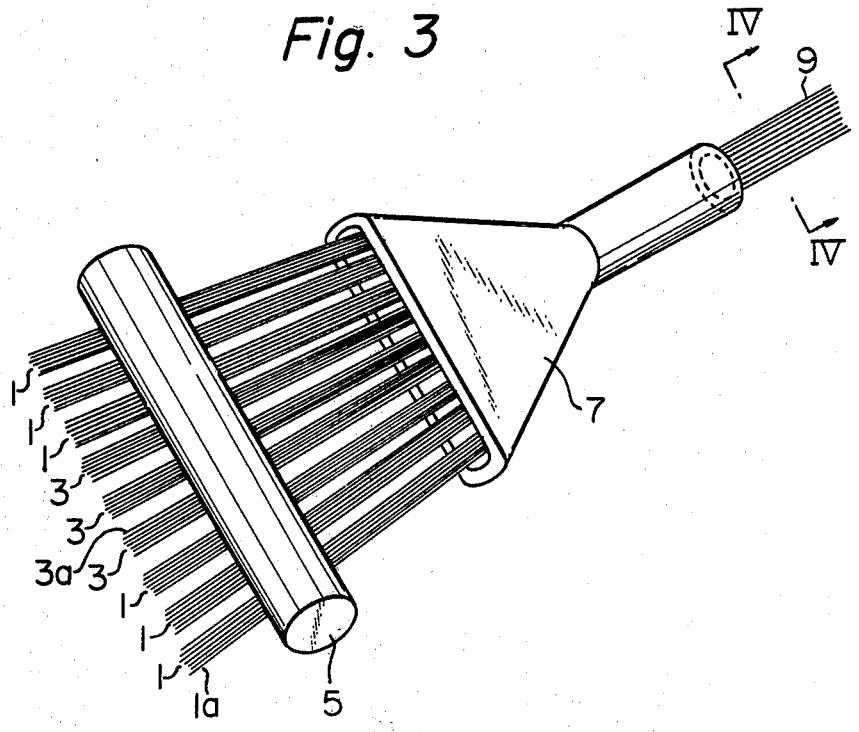
FIG. 3 is a perspective view of a process wherein a double layered sliver is prepared.
Figure 4:
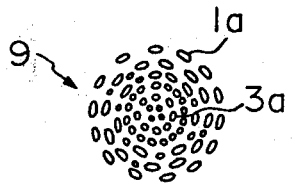
FIG. 4 is an enlarged diagrammatical cross sectional view taken along line IV—IV in FIG. 3.

In a first method, in a drawframe, as illustrated in FIG. 3, slivers 1 composed of fibers 1*a* having a high thermal shrinkage and slivers 3 composed of fibers 3*a* having a property being spontaneously extensible are parallelly drafted and delivered by a roller 5 to a trumpet guide 7. At the trumpet guide 7, the slivers 1 and 3 are gathered to form a double layered sliver 9 as illustrated in FIG. 4. The double layered sliver 9 is successively subjected to a roving operation and a spinning operation, but is not subjected to any doubling operation to avoid the destruction of the double layered structure, and accordingly, a double layered yarn having sheath and core structure is obtained.

Figure 5:
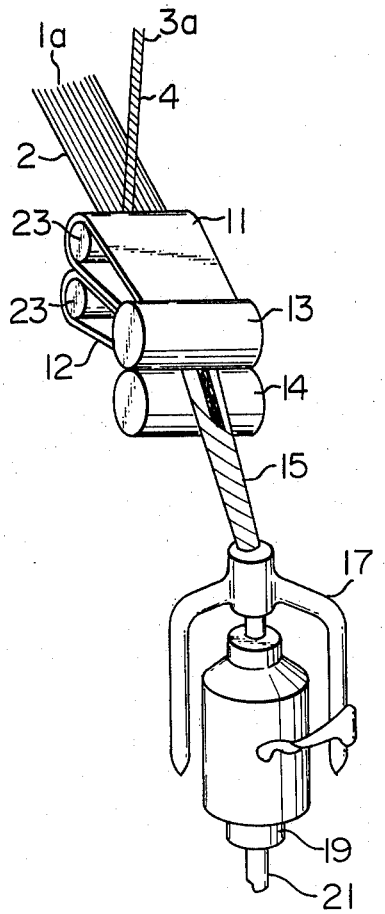
FIGS. 5 and 6 are perspective views of different processes wherein double layered yarns are prepared.
Figure 6:
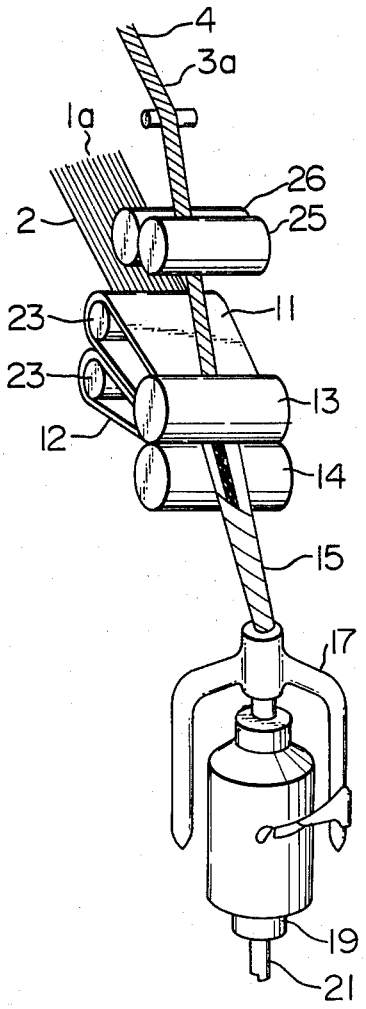

Referring to FIG. 5, in a second method, a sliver 2 composed of fibers 1*a* having a high thermal shrinkage is supplied to a pair of apron feeders 11 and 12, where it is drafted several times. On the other hand, a roving 4, which has been prepared in a roving process and which is composed of fibers 3*a* having a property being spontaneously extensible, is supplied to the apron feeder 11 and 12, where it is interposed with the sliver 2. The roving 4 and the sliver 2 are transferred together by means of a pair of front rollers 13 and 14 and are twisted by means of flyer 17, so that the sliver 2 wraps around the roving 4 in order to form a double layered roving 15. Then, the double layered roving 15 is wound on a bobbin 19 inserted on a rotatable spindle 21. The apron feeders 11 and 12 wrap around middle rollers 23. Referring to FIG. 6, the roving 4 is supplied to the front rollers 13 and 14 via a pair of supply rollers 25 and 26. In this case, the draft ratio between the supply rollers 25 and 26 and the front rollers 13 and 14 can be different from the draft ratio between the apron feeders 11 and 12 and the front rollers 13 and 14. Accordingly, by adjusting the draft ratios, the blending ratio of the staple fibers located at the sheath and core portions can easily be altered at will. The double layered roving 15, which has been obtained in the foregoing manner, is then subjected to a fine spinning operation in accordance with a conventionally known method.

In a third method, staple fibers which will constitute the sheath portion are wrapped around staple fibers which will constituted core portion in a fine spinning process, in a manner which is similar to that explained above the reference to FIGS. 5 and 6.

The obtained double layered yarn having a sheath and core structure is then subjected to a heat treatment, so that a bulky spun yarn of the present invention is obtained. The heat treatment may be effected in any known manner, such as in steam, in hot water or in dry heat. However, it is preferable that the double layered yarn be preheated for a period of between 30 minutes and 60 minutes in hot water, the temperature of which is between 70° C. and 100° C., so that the fibers located at the core portion and having a property being spontaneously extensible are preliminarily extended and intermediate portions of the fibers are bulged to a certain extent. Thereafter, the yarn is finally heat treated at a temperature equal to or more than 100° C., so that the fibers having a high thermal shrinkage are shrunk to the full extent, and as a result, a yarn which has been effectively bulked can be obtained.

The bulky spun yarn of the present invention, which is manufactured in the foregoing manner, has a specially designed shape and feel, which have been impossible to achieve in a conventional bulky spun yarn. More specifically, since according to the present invention, staple fibers including fibers having a property of being spontaneously extensible are located at the core portion and staple fibers including fibers having a thermal shrinkage are located at the sheath portion, so that a double layered yarn is formed and then is heat treated, the fibers having a thermal shrinkage gather toward the inside of the yarn less than fibers in a conventional yarn would. Accordingly, the fiber density at the central portion of the yarn is not excessively increased, and as a result, the bulky spun yarn of the present invention has a hand of bulkiness and is provided with a rich and well formed feeling. This is because, in the bulky spun yarn of the present invention, the fibers having a thermal shrinkage have been located mainly at the periphery, i.e., the sheath portion, of the yarn before they are heat treated, and when they are subjected to a heat treatment in order to thermally shrink them they do not completely gather at the central portion of the yarn. This is due to the fact that their free movement is prevented by the fibers which have been located at the central portion of the yarn and which have had a property being spontaneously extensible before the heat treatment.

Furthermore, in the bulky spun yarn of the present invention, the ends of fibers which have been located at the core portion and which have a property of being spontaneously extensible before they are subjected to a heat treatment are held within the inside of the bulky spun yarn, and intermediate portions of the fibers are bulged from the body portion of the bulky spun yarn. The amount of fuzz in the bulky spun yarn thus obtained can be minimized, and accordingly, the yarn provides a textile wherein the creation of pilling, which has often resulted from such fuzz, is also minimized. In addition, since the bulged fibers form loops and since the free ends of the fibers do not protrude from the body portion of the bulky spun yarn, the obtained bulky spun yarn has a very soft touch. When the spontaneous extension of the fibers located at the core portion in the double layered yarn is appropriate, the disturbance of the parallelism of the fibers located at the periphery in the bulky spun yarn can be minimized while the yarn is subjected to bulking operation. Consequently, loops which are free from fuzz cover the periphery of the yarn, and accordingly, the roughness and the harshness, which are unavoidable to a conventional bulky spun yarn, can remarkably be removed.

As mentioned above, according to the present invention, an improved bulky spun yarn which has an excellent appearance and hand differing from those of a conventional spun yarn, and which creates a relatively small number of pillings, can be obtained.

Some examples of the present invention will now be explained.

EXAMPLE 1

In this Example, many combinations of fibers having a thermal shrinkage and fibers having a spontaneously extensible property were examined and, as a result, the preferable ranges of the thermal shrinkage and spontaneous extension were found.

In this Example, according to the method explained with reference to FIG. 5, double layered yarns were prepared in a roving process. In the process polyester fibers, having a denier of 2 de and a fiber length of 61 mm which had various thermal shrinkages, in accordance with the combinations described in Table 1, were located at the sheath portion. The blended fiber ratio of the fibers was 40%. Polyester fibers, having a denier of 2 de and a fiber length of 61 mm which had various thermal shrinkages, in accordance with the combinations described in Table 1, were located at the sheath portion. The blended fiber ratio of the fibers was 40%. Polyester fibers having a denier of 2 de and a fiber length of 51 mm, which had various spontaneous extensions at a temperature of 180° C., in accordance with the combinations described in Table 1, were located at the core portion. The double layered yarns thus prepared were subjected to a heat treatment in hot water, the temperature of which was 150° C., so that a bulky spun yarn having a metric count of $2/48^s$ was obtained. The appearance of loops in the bulky spun yarns was visually evaluated by an expert. The obtained results, i.e., "excellent", "good" and "poor", are shown in Table 1. Furthermore, the thermal shrinkages in boiling water of the obtained bulky spun yarns were measured, and the obtained results, in %, are also shown in Table 1.

It was confirmed that the thermal shrinkage of the fibers located at the sheath portion in the double layered yarn should be equal to or more than 5%, in order to obtain a bulky spun yarn having a good bulkiness. It was also confirmed that the spontaneous extension of the fibers located at the core portion in the double layered yarn should be equal to or more than 3%, in order to effectively replace the fibers located at the sheath portion with those located at the core portion.

TABLE 1

| Spontaneous Extension | Thermal Shrinkage | | | | | |
|---|---|---|---|---|---|---|
| | 3.0% | 5.0% | 13.0% | 20.0% | 30.0% | 39.0% |
| −1.0%* | poor | poor | poor | poor | good | good |
| | 2.6% | 4.5% | 13.1% | 20.1% | 29.4% | 31.5% |
| 3.0% | poor | good | good | good | excellent | excellent |
| | 3.1% | 5.9% | 13.8% | 21.8% | 30.3% | 32.4% |
| 6.0% | poor | good | good | excellent | excellent | excellent |
| | 3.5% | 6.9% | 14.1% | 22.5% | 31.6% | 34.7% |

*Fibers having a thermal shrinkage were utilized.

EXAMPLE 2

In this Example, the bulkiness of the bulky spun yarn of the present invention was compared with the bulkiness of conventional bulky spun yarns.

Figure 7:
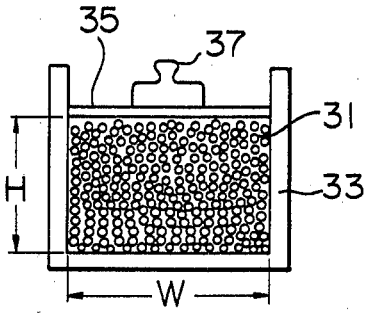
FIG. 7 is an elevational view of a measuring device by which the bulkiness of spun yarns are measured.
Figure 8:
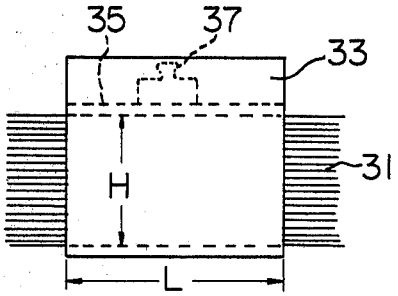
FIG. 8 is a side view of the measuring device illustrated in FIG. 7.
Figure 9:
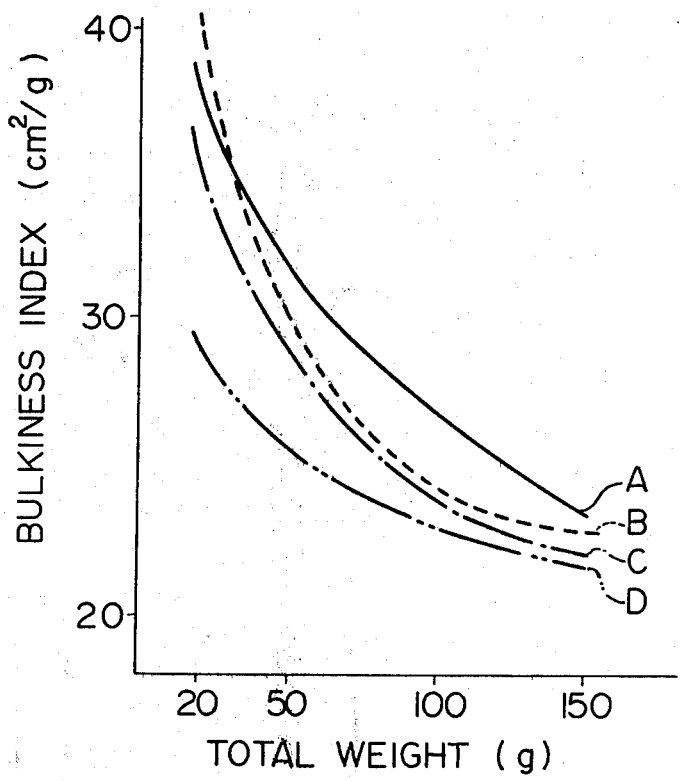
FIG. 9 is a diagram which illustrates the relationships of the spun yarns between a bulkiness index and total weight.

Test pieces, i.e., various spun yarns, were formed into hanks, and then, the hanks, in a relaxed condition, were treated for 30 minutes in hot water, the temperature of which was 100° C. After the yarns were dried, they were cut into pieces 10 cm long. The 800 pieces of cut yarns 31 were aligned in a U-shaped jig 33 which had a width W of 2 cm and a length L of 5 cm, as illustrated in FIGS. 7 and 8. A cover 35 and a weight 37 were placed on top of the aligned cut yarns 31. In FIG. 9, the total weight in g of the cover 35 and the weight 37 is plotted on the abscissa, and the bulkiness index, which was calculated based on the following equation by utilizing the height H in cm of the compressed yarn 31, is plotted on the ordinate.

$$\text{Bulkiness index} = \frac{2 \times H \times Nm \times 100}{800} \ (\text{cm}^3/\text{g})$$

wherein, Nm designates the metric count of the yarn.

FIG. 9 is a diagram which illustrates the relationships between the bulkiness index and the total weight of the various spun yarns manufactured in accordance with the present invention and a conventional method. It should be noted that only the bulky spun yarn of the present invention was double layered.

TABLE 2

| | Metric Count Structure | Fibers having a thermal shrinkage: Material | Thermal shrinkage | denier × length | Blended fiber ratio | Fibers having a property being spontaneously extensible: Material | Spontaneous Extension | denier × length | Blended fiber ratio |
|---|---|---|---|---|---|---|---|---|---|
| A: Solid line | 2/48 | Polyester | 18% | 3de × 64~89mm | 50% | Polyester | 8% | 3de × 64~89mm | 50% |
| Bulky Spun Yarn of Present Invention | Double layered | | | | | | | | |
| B: Broken line | 2/48 | Polyester | 18% | 3de × 64~89mm | 40% | Polyester | 8% | 3de × 64~89mm | 60% |
| Conventional Bulky Spun Yarn | Randomly mixed | | | | | | | | |
| C: Single dot dash line | 2/48 | Polyester | 18% | 3de × 64~89mm | 40% | | | | |
| Conventional Bulky Spun Yarn | Randomly mixed | Polyester | 3% | 3de × 64~89mm | 60% | | | | |
| D: Two dot dash line | 2/48 | Polyester | 3% | 3de × 64~89mm | 100% | | | | |
| Conventional Spun Yarn | Randomly mixed | | | | | | | | |

Referring to FIG. 9, it is apparent that the bulky spun yarn of the present invention has a comparatively high bulkiness index, which is a measure of a resistance against the external compression force at the total weight of 20 g, and that the bulky spun yarn of the present invention can have a high bulkiness index even if the total weight is increased. It is required that the spun yarn have a bulkiness index of at least 30 $cm^3/g$ at a total weight of 20 g for actual use.

To compare the characteristics of the spun yarns, the inventors of the present invention have introduced a compression-bulkiness coefficient $V_p$ which is defined as follows.

$$V_p=(S_1/S_0)\times 100\%$$

Figure 10:
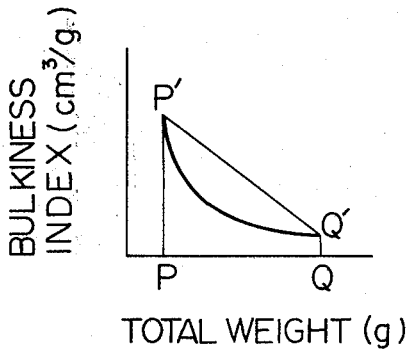
FIG. 10 is a diagram which is utilized to explain the compression-bulkiness coefficient.

Wherein, $S_0$ is the area of the trapezoid PP'QQ' illustrated in FIG. 10, and; $S_1$ is the area surrounded by the absissa PQ, vertical lines PP' and QQ', and the curve P'Q'. The line P'Q' designates the linear change. The compression-bulkiness coefficient $V_p$ defined above indicates the effectiveness of actual change. Naturally if the compression-bulkiness coefficient $V_p$ is large, the yarns have a good bulkiness. The inventors of the present invention believe that the actual spun yarn should have a compression-bulkiness index of more than 70%. The results obtained are summarized in Table 3.

TABLE 3

| | $V_p$ % | | Bulkiness at 20g |
|---|---|---|---|
| A: Bulky Spun Yarn of Present Invention | 84.6 | excellent | excellent |
| B: Conventional Bulky Spun Yarn | 57.6 | poor | excellent |
| C: Conventional Bulky Spun Yarn | 64.8 | poor | excellent |
| D: Conventional Spun yarn | 73.9 | good | poor |

EXAMPLE 3

A roving mechanism illustrated in FIG. 5 was utilized. A roving composed of polyester staple fibers, each of which had a denier of 1.5 de and a fiber length of 38 mm, and a spontaneous extension of 6% at a temperature of 150° C., was located at the core portion. The blended fiber ratio of the staple fibers was 40%. A mixed sliver composed of polyester staple fibers which had a denier of 1.8 de and a fiber length of 51 mm and which had a high thermal shrinkage in boiling water of 10%, and the blended fiber ratio of which was 30%, and; polyester staple fibers which had a denier of 1.8 de and a fiber length of 51 mm and which had a thermal shrinkage in boiling water of 3%, and the blended fiber ratio of which was 30%, was prepared. The roving and the mixed sliver were formed into a double layered yarn. Thereafter, the double layered yarn was subjected to a heat treatment in hot water, the temperature of which was 150° C. As a result, a bulky spun yarn was obtained, in which the ends of the fibers having spontaneous extensible property were held within the spun yarn and the intermediate portions of the fibers were bulged from the body portion of the spun yarn, and in addition, the fibers having a high thermal shrinkage were concentrated toward the inside of the yarn. The amount of fuzz in the obtained yarn was small and the yarn had a smooth feeling.

Figure 11:
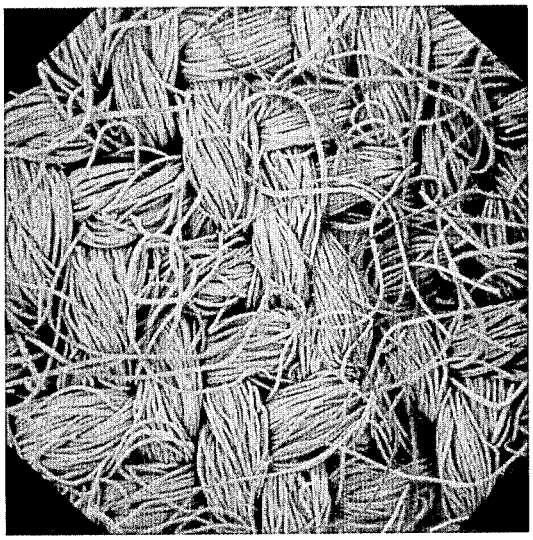
FIG. 11 is a photograph of a woven fabric wherein conventional spun yarns are utilized.
Figure 12:
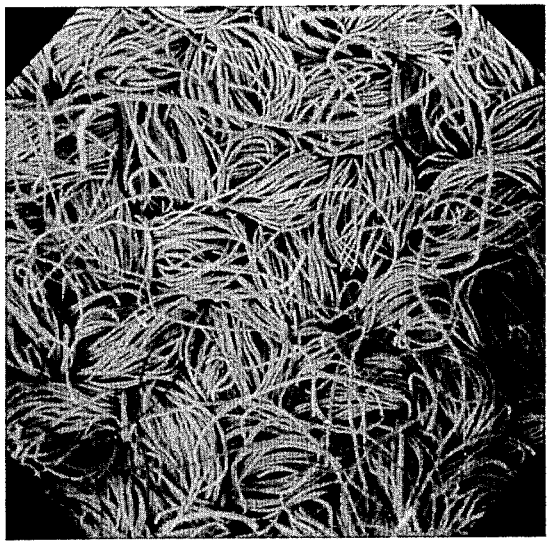
FIG. 12 is a photograph of a woven fabric wherein bulky spun yarns according to the present invention are utilized.

FIGS. 11 and 12 are photographs of the woven fabrics wherein conventional randomly mixed spun yarns and bulky spun yarns of the present invention were utilized, respectively. It is obvious that, since the surface of the woven fabric illustrated in FIG. 12, wherein the bulky spun yarn of the present invention are utilized, is covered with loops. The woven fabric illustrated in FIG. 12 has a hand superior to that of the woven fabric illustrated in FIG. 11, wherein the conventional randomly mixed spun yarns are utilized.

The detailed structures of the woven fabrics illustrated in FIGS. 11 and 12 are described in Table 4.

TABLE 4

| | FIG. 11 Conventional randomly mixed spun yarn | FIG. 12 Double layered according to Present invention |
|---|---|---|
| BULKY SPUN YARN | | |
| Metric count | $2/48^S$ | $2/48^S$ |
| Staple fibers 1 | Polyester fibers having high thermal shrinkage of 18% | Polyester fibers having high thermal shrinkage of 18% |
| denier × fiber length | 4 de × 64~89 mm | 4 de × 64~89 mm |
| blended fiber ratio | 40% | 35% |
| | | Polyester fibers having thermal shrinkage of 3% 3 de × 64~89 mm 30% (Fibers are mixed and located at the sheath portion) |
| Staple fibers 2 | Polyester fibers having low thermal shrinkage of 3% | Polyester fibers having spontaneous extension of 8% |
| denier × fiber length | 3 de × 64~89 mm | 2 de × 51 mm |
| blended fiber ratio | 60% | 35% |
| WOVEN FABRIC | | |
| fabric structure | 2/2 twill | 2/2 twill |
| set (warp × weft) | 75/in × 60/in | 74/in × 62/in |

What we claim is:

1. A method for manufacturing a bulky spun yarn characterized by:

preparing a double layered yarn having a sheath and core structure, the sheath portion of said yarn being composed of thermoplastic staple fibers which include fibers having a high thermal shrinkage in boiling water of at least 5%, and the blended fiber ratio of which fibers is between 50% and 25%, and the core portion of said yarn being composed of thermoplastic staple fibers which include fibers having a property of being spontaneously extensible under heating conditions, and the blended fiber ratio of which fibers is between 25% and 75%, and;

heat treating said prepared double layered yarn, whereby the intermediate portions of said fibers having a property of being spontaneously extensible are bulged from the body portion of said yarn, and said fibers having a high thermal shrinkage are concentrated toward the inside of said bulky spun yarn.

2. A method according to claim 1, wherein the sum of the thermal shrinkage of said fibers located at said sheath portion in said double layered yarn and the spontaneous extension of said fibers located at said core portion in said double layered yarn is at least 8%.

3. A method according to claim 1, wherein said thermoplastic polymer is a polyester.

4. A method according to claim 1, wherein each of said fibers located at said sheath portion in said double layered yarn has a denier between 1.0 de and 15 de and a fiber length between 24 mm and 250 mm.

5. A method according to claim 1 or 4, wherein each of said fibers located at said core portion in said double layered yarn has a denier between 0.5 de and 10 de and a fiber length between 24 mm and 280 mm.

6. A method according to claim 1, wherein said double layered yarn is subjected to a preliminarily heat treatment for a period of time between 30 minutes and 60 minutes, at a temperature between 70° C. and 100° C., and thereafter, is subjected to a heat treatment at a temperature of at least 100° C.

7. A method according to claim 6, wherein said heat treatments takes place in hot water.

8. A bulky spun yarn prepared by the method of claim 1.

9. A bulky spun yarn according to claim 8, wherein the blended fiber ratio of said first mentioned staple fibers is between 50% and 25%, and the blended fiber ratio of said last mentioned staple fibers is between 25% and 75%.

10. A bulky spun yarn according to claim 8 or 9, wherein said thermoplastic polymer is a polyester.

* * * * *